US008082057B2

(12) United States Patent
Allen et al.

(10) Patent No.: US 8,082,057 B2
(45) Date of Patent: Dec. 20, 2011

(54) CARPET DYEING SYSTEMS AND METHODS

(75) Inventors: Mick Allen, Summerville, GA (US); Ronnie Cargle, Summerville, GA (US); Randy Hixon, Dalton, GA (US); Keith Bray, Plainville, GA (US); Ron Paynter, Rock Spring, GA (US)

(73) Assignee: Mohawk Carpet Distribution, Inc., Calhoun, GA (US)

( * ) Notice: Subject to any disclaimer, the term of this patent is extended or adjusted under 35 U.S.C. 154(b) by 474 days.

(21) Appl. No.: 12/108,875

(22) Filed: Apr. 24, 2008

(65) Prior Publication Data

US 2008/0295258 A1 Dec. 4, 2008

Related U.S. Application Data

(60) Provisional application No. 60/913,718, filed on Apr. 24, 2007, provisional application No. 60/938,093, filed on May 15, 2007, provisional application No. 61/018,825, filed on Jan. 3, 2008.

(51) Int. Cl.

| | |
|---|---|
| ***G06F 19/00*** | (2011.01) |
| ***D06P 1/00*** | (2006.01) |
| ***D06P 5/00*** | (2006.01) |

(52) U.S. Cl. ..... 700/133; 700/130; 700/131; 700/132; 8/400; 8/478; 8/636; 8/929

(58) Field of Classification Search ..... 8/400, 478, 8/636, 929; 700/130–133; 428/85
See application file for complete search history.

(56) References Cited

U.S. PATENT DOCUMENTS

| | | | | |
|---|---|---|---|---|
| 3,566,630 | A | 3/1971 | Appenzeller | |
| 3,602,968 | A | 9/1971 | Adolff et al. | |
| 3,954,404 | A | 5/1976 | Childers et al. | |
| 3,968,638 | A | 7/1976 | Norton et al. | |
| RE29,251 | E | 6/1977 | Appenzeller et al. | |
| 4,116,626 | A | 9/1978 | Varner | |
| 4,319,388 | A | 3/1982 | Champaneria et al. | |
| 4,468,230 | A | 8/1984 | Thomas et al. | |
| 4,649,079 | A | 3/1987 | Guilbault et al. | |
| 4,808,191 | A * | 2/1989 | Gregory et al. | 8/478 |
| 4,862,713 | A | 9/1989 | Kutz et al. | |
| 4,979,380 | A | 12/1990 | Robbins et al. | |
| 6,050,282 | A | 4/2000 | Whaley | |
| 6,245,116 | B1 | 6/2001 | Pechhold et al. | |
| 6,305,421 | B1 | 10/2001 | Ahrweiler | |
| 6,811,574 | B2 | 11/2004 | Baumann et al. | |
| 6,852,134 | B2 | 2/2005 | Baumann et al. | |
| 2003/0139840 | A1 | 7/2003 | Magee | |

FOREIGN PATENT DOCUMENTS

| | | |
|---|---|---|
| EP | 1728911 | 6/2006 |
| WO | WO/2004/065685 A2 | 8/2004 |

OTHER PUBLICATIONS

"Carpet Finishing," *KÜSTERS*, Division Textile, 2003.
Dennard, "From Start to Finish," *Textile World*, http://www.textileworld.com/news.htm?CD=1377&3552, Mar. 2003.
"Process Technology," *KÜSTERS*, Division Textile, 2003.
"Continuous Dyeing of Wool Carpets, Wools of New Zealand," 2002.
European Search Report dated Aug. 28, 2008; Application No. EP 08 15 5132.7, filed Apr. 24, 2008.
Canadian Office Action dated Jan. 12, 2010; Application No. 2,629,856.
Canadian Office Action dated Mar. 30, 2011; Application No. 2,629,856.
European Office Action dated Mar. 10, 2011; Application No. 08155132.7.
European Search Report dated Oct. 7, 2011; Application No. EP 11 15 6678.

* cited by examiner

*Primary Examiner* — Lorna M Douyon
*Assistant Examiner* — Tanisha Diggs
(74) *Attorney, Agent, or Firm* — Alston & Bird LLP

(57) ABSTRACT

Embodiments of the present invention provide systems and methods for "dye-to-order" carpet manufacturing that address deficiencies in the carpet manufacturing industry, some of which are discussed above. In one embodiment, an improved manufacturing system is provided that allows manufacturers to change colors "on the fly" (e.g., within a single roll) with minimal waste. In another embodiment, a dye-to-order processing system is provided that maps multiple orders to undyed carpet rolls such that usage of the undyed carpet rolls is optimized.

7 Claims, 8 Drawing Sheets

CARPET DYEING SYSTEMS AND METHODS

CROSS-REFERENCE TO RELATED APPLICATIONS

This application claims priority to U.S. Provisional Application No. 60/913,718 filed Apr. 24, 2007, U.S. Provisional Application No. 60/938,093 filed May 15, 2007, and U.S. Provisional 61/018,825 filed Jan. 3, 2008, which are hereby incorporated herein in their entirety by reference.

BACKGROUND OF THE INVENTION

A typical high volume carpet manufacturing process requires dyeing an entire roll of carpet in one color. The roll of carpet is then warehoused by the manufacturer until a customer orders a length of carpet of that color. For common colors, this process works relatively efficiently as there is a constant demand. However, for less popular colors, a major portion of a roll of that color can remain warehoused for a long period of time. When considering that some carpet styles can have up to 60 different colors, the inventory costs become very large. Thus, a challenge facing carpet manufacturers is how to produce a wide variety of colors and styles of carpet without having to carry large inventories of less popular varieties.

Attempts have been made to reduce the transition time necessary to change colors, such that it is economical to produce different color carpets on a single roll, with limited success. In one known method, a vacuum purge system is used to evacuate a first dye color and simultaneously switch to a second dye color. Although known as a "quick-change" dye machine, changing the dye color creates an unusable section of carpet of 18" or more in length when the carpet is run at a typical 60 feet per minute, and carpet may be run as fast as 160 feet per minute depending on carpet weight. This carpet waste has discouraged companies from changing colors in the middle of a roll. A need in the art therefore exists for a carpet dyeing process that can efficiently produce at least two different colors in a single roll.

An additional challenge facing carpet manufacturers is how to process orders to reduce the need to warehouse less popular styles and colors. Typically, a manufacturer will create a high level production plan identifying time frames for producing various styles of carpet based on demand forecasts and average orders per month. This production plan can be used to order raw materials and is often referred to when providing a customer with a promised delivery date.

On a daily or weekly basis, a production schedule is created. This schedule is more detailed than the production plan and typically identifies the SKUs to be produced and allots time on a particular product line or piece of equipment to produce the particular SKUs. A "SKU" is a number identifying a product sold and the term "SKU" will be used herein to refer to a particular style and color of carpet. When an order is received for a particular SKU, known order processing systems search the manufacturer's inventory to satisfy the order. If the order cannot be satisfied with present inventory, an entire roll of that particular SKU is scheduled for production. The unused portion of the carpet roll is then stored in a warehouse. Thus, there is a need in the art to increase efficiency of the order process and reduce the carpet manufacturer's inventory costs.

BRIEF SUMMARY OF THE INVENTION

The above and other needs are met by the present invention which, in one embodiment, provides a method of dyeing carpet to satisfy a plurality of customer orders. The method includes the steps of: receiving a plurality of customer orders wherein each order identifies a color and a length; determining which of the plurality of customer orders can be dyed in sequence based on the colors identified by the respective orders without creating an unacceptable visual effect of blending of sequential dyes at a transition between colors in the sequence; assigning the plurality of customer orders to one or more greige rolls of carpet based at least in part on the determined dyeing sequence wherein at least one greige roll of carpet has at least one transition from one color to another color; and dyeing the one or more greige rolls of carpet.

In another embodiment, a method of dyeing a continuous greige roll of carpet a plurality of colors is provided. The method includes the steps of: mixing a first dye solution for a first color in a first mixing system; mixing a second dye solution for a second color in a second mixing system; feeding a greige roll of carpet through a dye application system; actuating at least one multi-port valve in the dye application system such that the first dye solution is applied to a first portion of the greige roll of carpet as it passes through the dye application system; actuating the at least one multi-port valve in the dye application system such that the second dye solution is applied to a second portion of the greige roll of carpet as it passes through the dye application system; mixing a third dye solution for a third color in the first mixing system while the second dye solution is being applied; purging residue of the first dye solution from the mixing system and at least a portion of the dye application system using the third dye solution; and actuating the at least one multi-port valve in the dye application system such that the third dye solution is applied to a third portion of the greige roll of carpet as it passes through the dye application system.

In a further embodiment, a roll of dyed carpet having two different dyed colors is provided. The carpet roll includes a first length of the carpet roll dyed a first color; a second length of the carpet roll dyed a second color; and a demarcation strip of undyed carpet positioned between the first length and second length of carpet having a length less than 18 inches.

In an additional embodiment, a method for dyeing a carpet roll a plurality of colors according to customer orders is provided. The method includes the steps of: receiving a first order identifying a first color and a first length; receiving a second order identifying a second color and a second length; determining a sequence in which to dye the roll of carpet the first color and the second color and mapping the first and second order to the roll of carpet are based on at least one of the following criteria: (a) reducing unacceptable visual effect of blending of sequential dyes at a transition between colors in the sequence; (b) reducing the amount of unused carpet on the carpet roll; (c) the relative popularity of the colors; (d) inventory levels of carpet dyed the first color and the second color; dyeing the roll of carpet to satisfy the first order comprising a first color and a first length and the second order comprising a second color and a second length in the determined sequence; and cutting the dyed roll of carpet to separate the first order from the second order.

In a further embodiment, a tufted product is provided. The tufted product includes a backing having a width and a length; yarn tufted to the backing to create a roll of carpet having a length and a width; wherein a first length of the roll of carpet is dyed a first color according to a customer order specifying the first color and a first length; and wherein a second length of the roll of carpet is dyed a second color according another customer order specifying the second color and a second length.

In an additional embodiment, a carpet dying system is provided. The system includes a first mixing system including a first plurality of dye holding tanks in selective fluid communication with a first mixing tank wherein the first mixing system is configured to combine dye from the first plurality of dye holding tanks to create a first dye solution; at least a second mixing system including a second plurality of dye holding tanks in selective communication with a second mixing tank wherein the second mixing system is configured to combine dye from the second plurality of dye holding tanks to create a second dye solution; a dye application head in fluid communication with the first mixing system and the second mixing system for applying dye to the carpet; and at least one multi-port valve in fluid communication between the first and second mixing systems, the dye application head and a drain, the at least one multi-port valve being configured for selectively providing fluid communication: (1) between the first dye mixing system and the dye application head, and between the second dye mixing system and a drain such that residue of previous dye solutions in the second mixing system is purged by the second dye solution, or (2) between the first dye mixing system and the drain such that residue of previous dye solutions in the first mixing system is purged by the first dye solution, and between the second dye mixing system and the dye application head.

In another embodiment, a computer apparatus for mapping customer orders for colors of carpet to greige rolls of carpet is provided. The computer apparatus includes: one or more databases associating predetermined carpet colors with a plurality of characteristics of a respective carpet color including dye concentrations for achieving the color, a popularity ranking of the color amongst customers and an inventory of carpet already dyed the color; one or more processors in communication with the one or more databases wherein the processors are configured to: receive a plurality of customer orders wherein each order identifies a predetermined color and a length; determine which customer orders qualify for dye-to-order processing based at least in part on the popularity ranking of the colors ordered, the length of ordered carpet for respective orders and the inventory of the colors ordered; determine which of the qualified dye-to-order customer orders can be dyed in sequence based on the color of the respective customer orders without creating an unacceptable visual effect of blending of sequential dyes at a transition between different colors; and map the qualified customer orders to greige rolls having predetermined lengths based in part on the sequence determination and on the ordered lengths to reduce the length of unallocated portions of the greige rolls.

BRIEF DESCRIPTION OF THE SEVERAL VIEWS OF THE DRAWINGS

Figure 1:
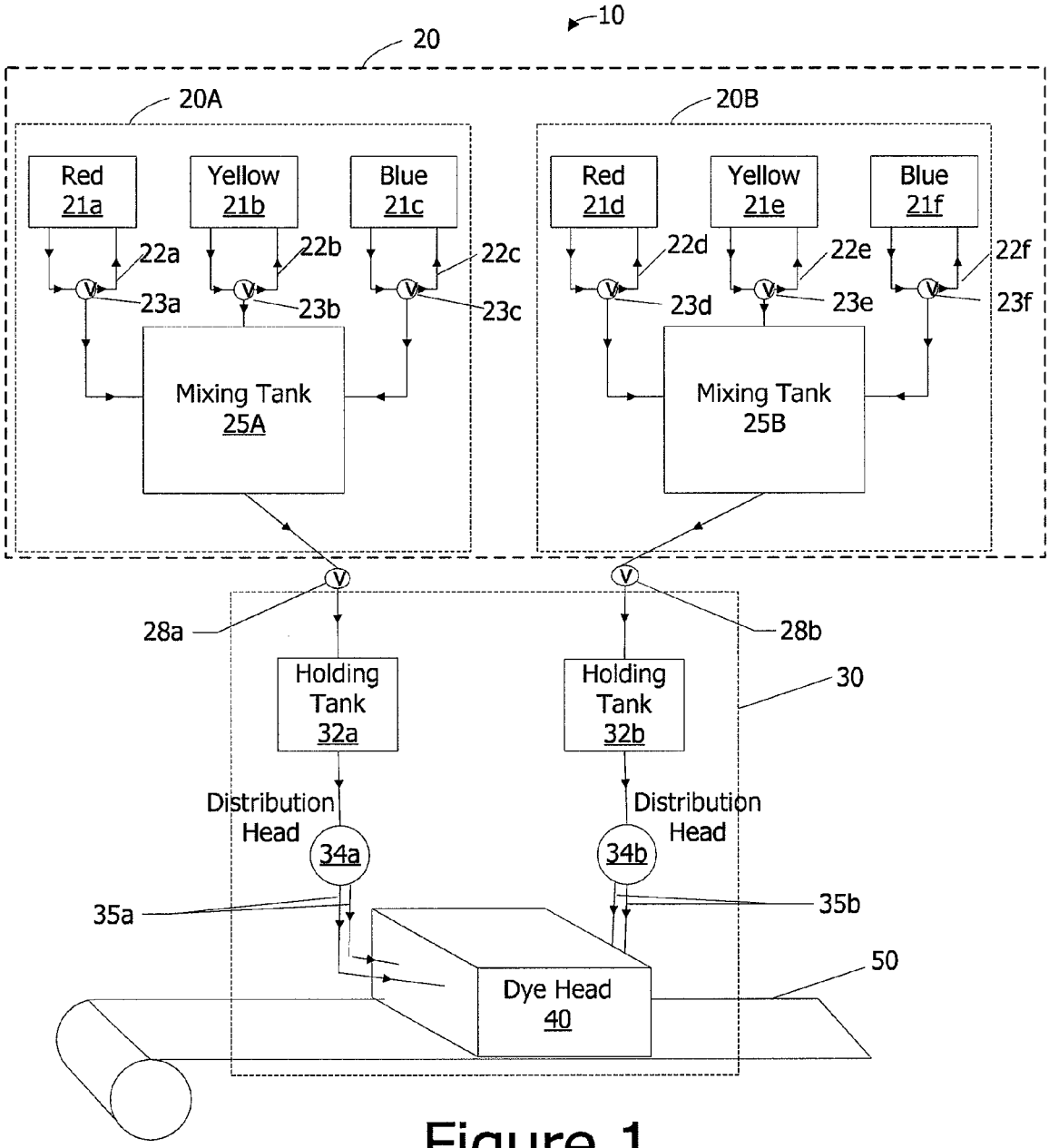

Having thus described the invention in general terms, reference will now be made to the accompanying drawings, which are not necessarily drawn to scale, and wherein:

FIG. 1 is a schematic diagram of a carpet dyeing system in accordance with an embodiment of the present invention.

Figure 2:
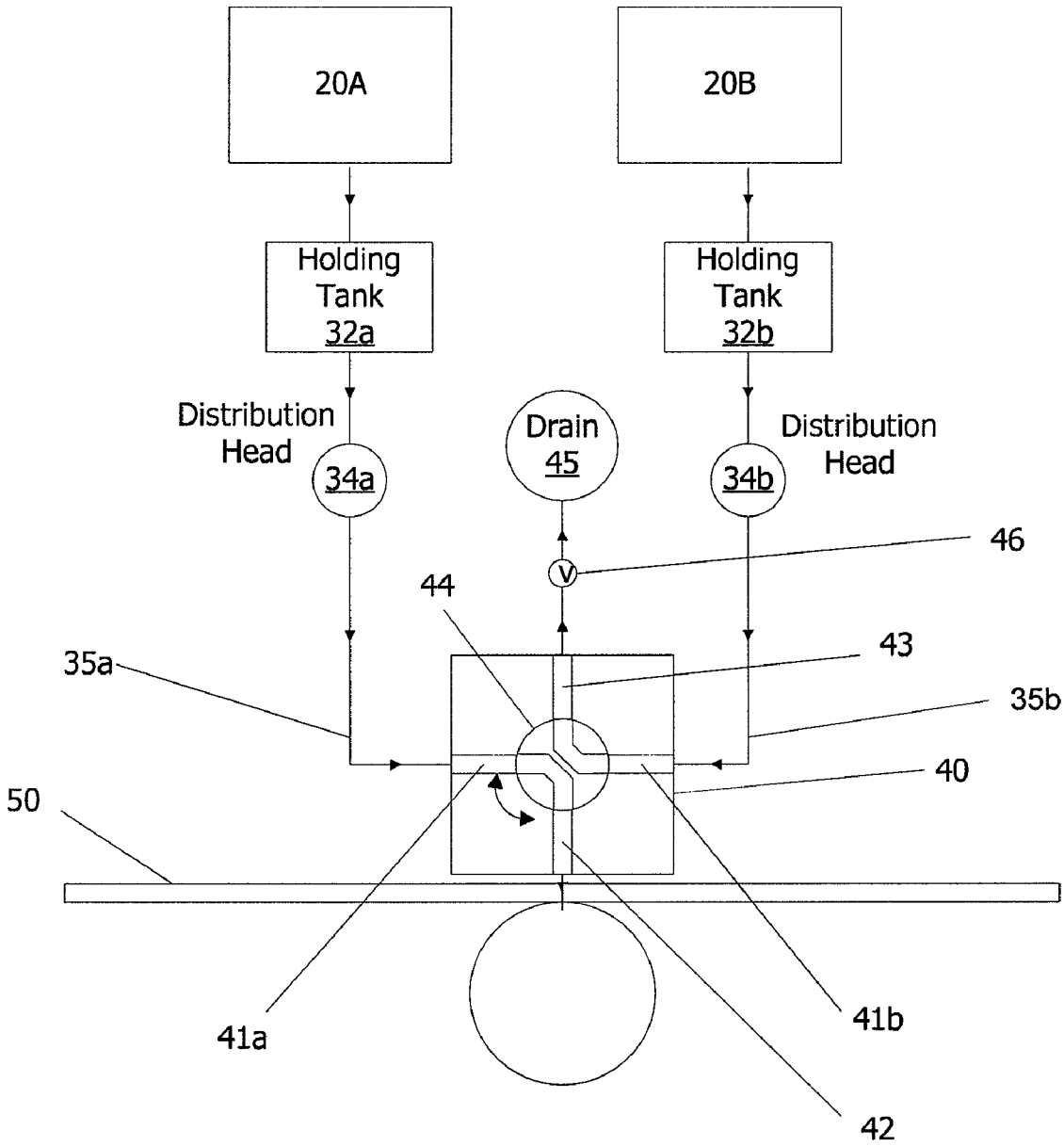

FIG. 2 is a schematic diagram of a carpet dye application system in accordance with an embodiment of the present invention.

Figure 3:
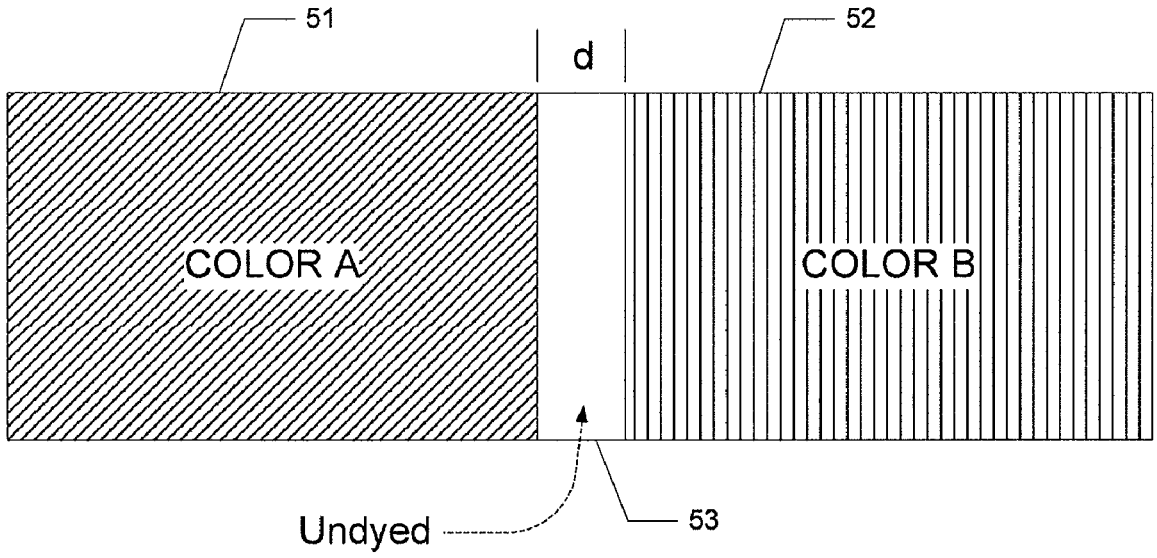

FIG. 3 is a schematic diagram of a portion of a roll of carpet illustrating two different colors and a demarcation strip.

Figure 4:
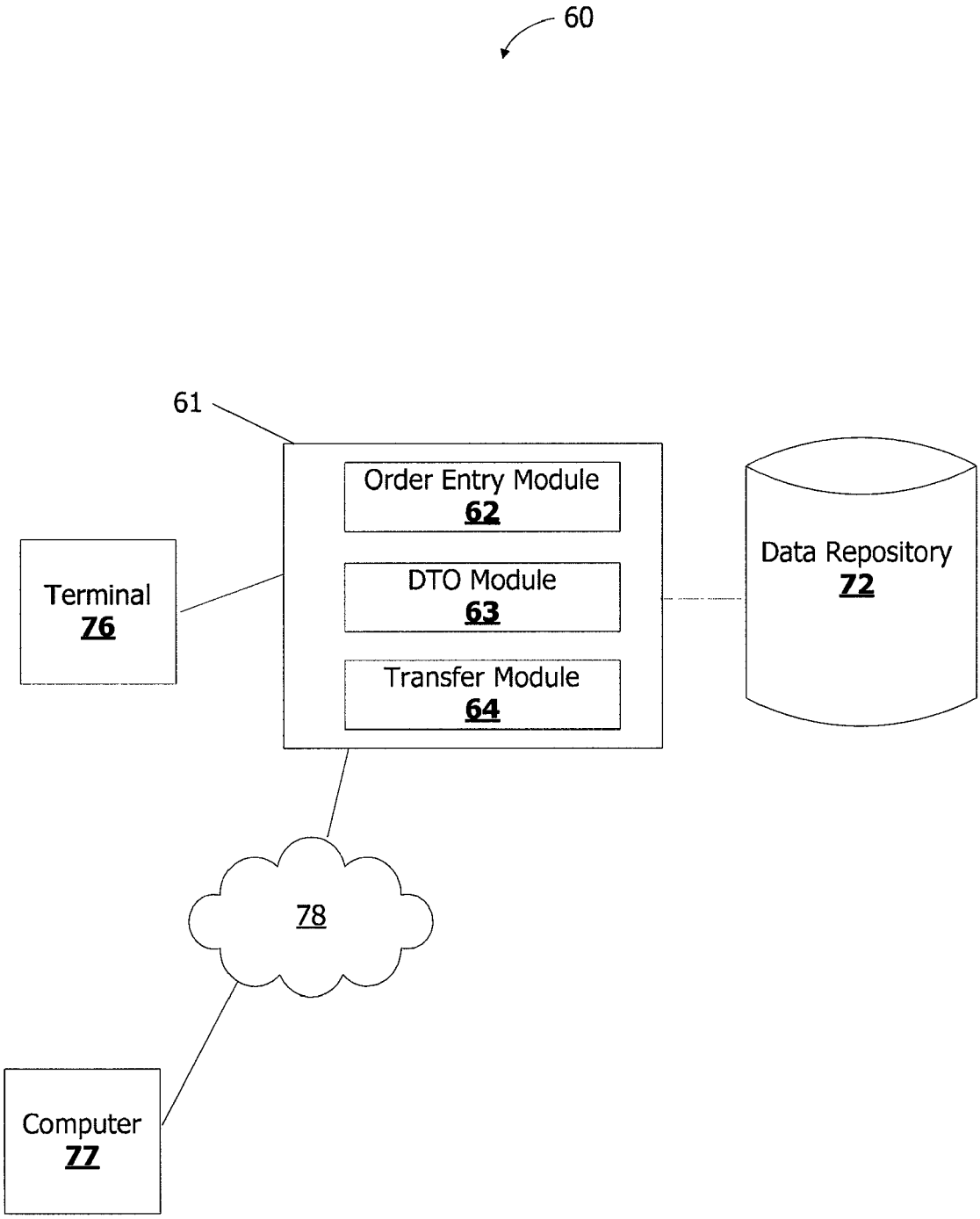

FIG. 4 is a schematic diagram illustrating an exemplary architecture for a dye-to-order processing system.

Figure 5:
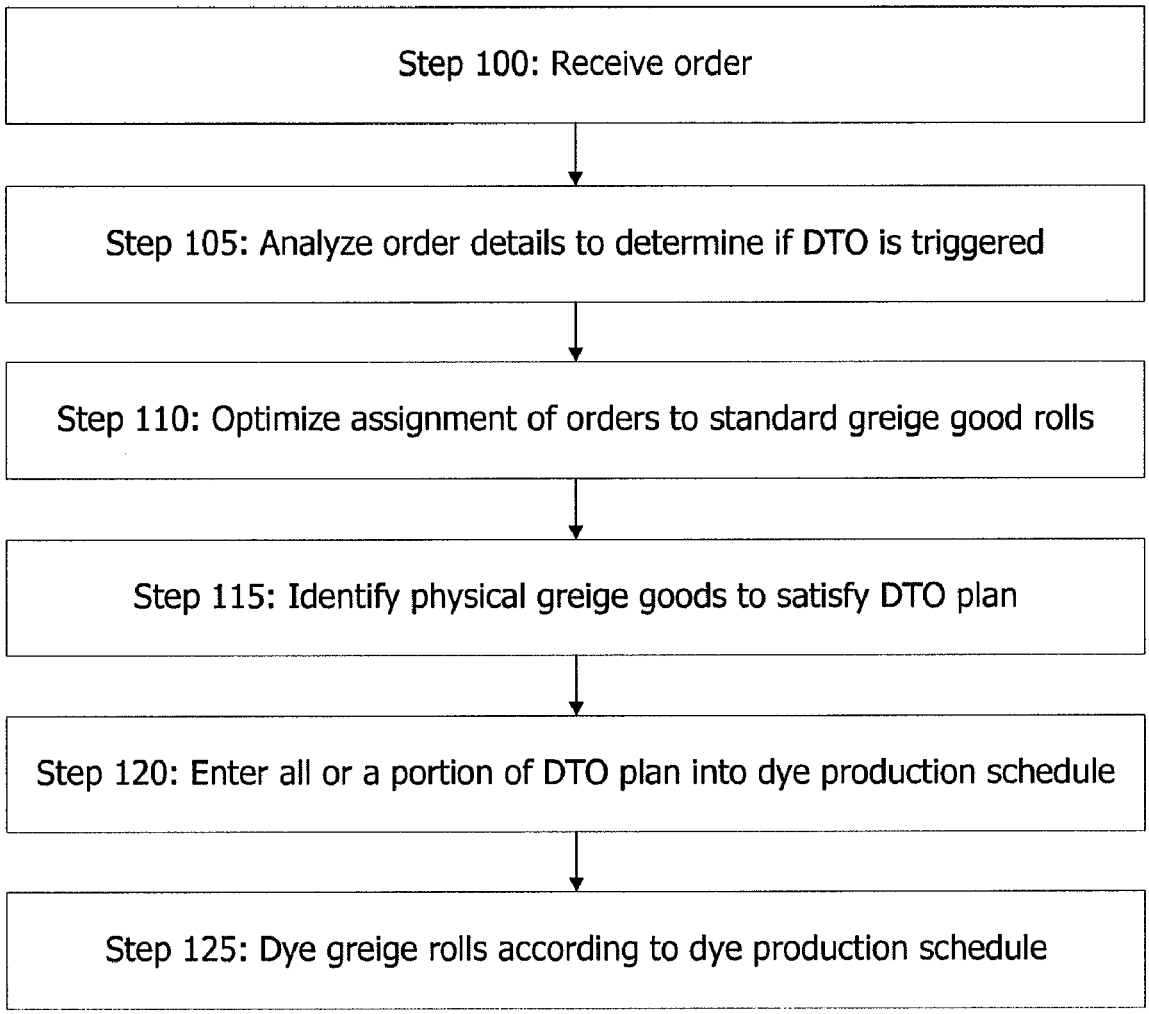

FIG. 5 is a flow diagram illustrating exemplary steps for processing orders in a dye-to-order processing system in accordance with an embodiment of the present invention.

Figure 6:
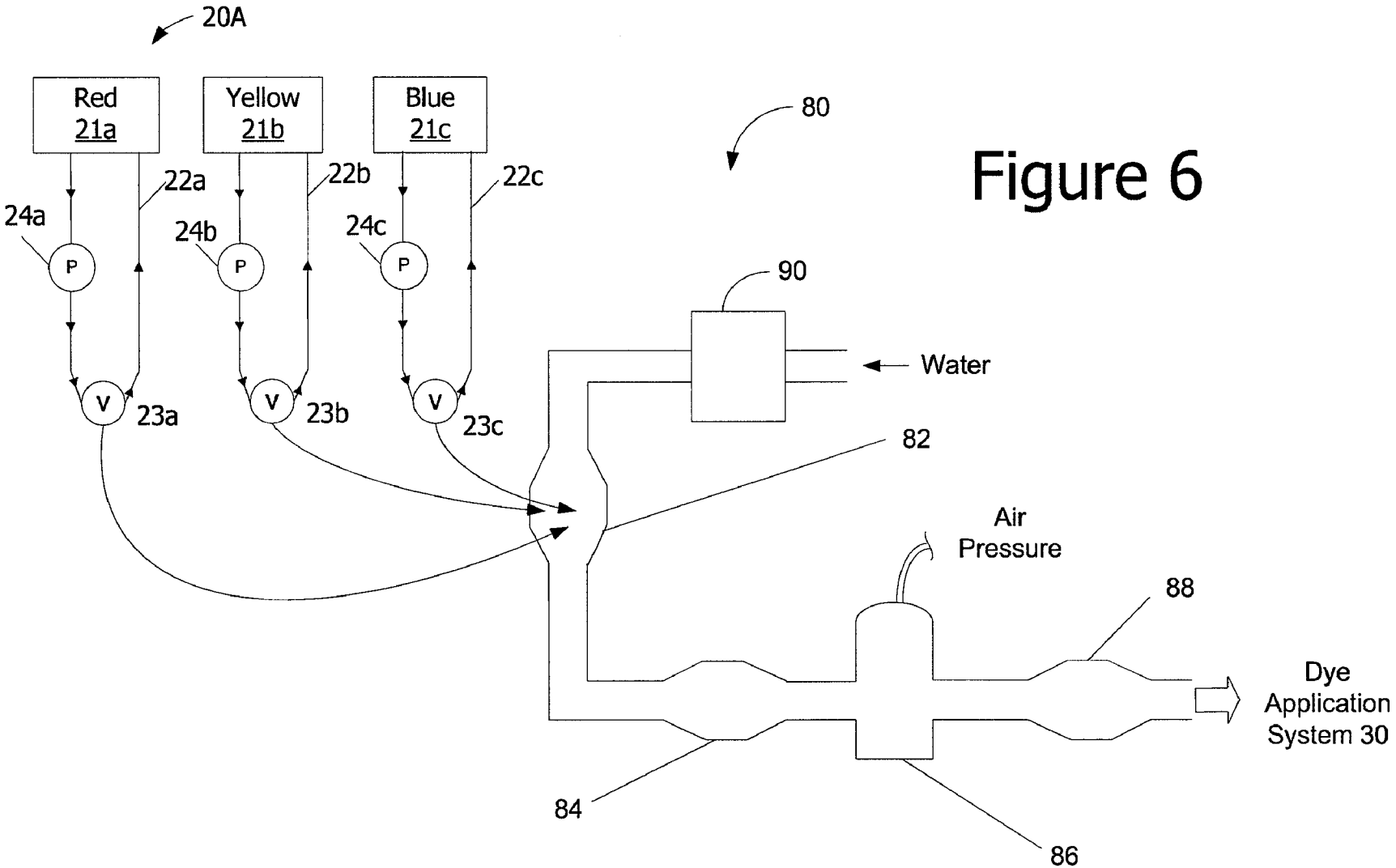

FIG. 6 is a schematic diagram of a piping system for mixing a dye solution and providing the dye solution to a dye application system.

Figure 7:
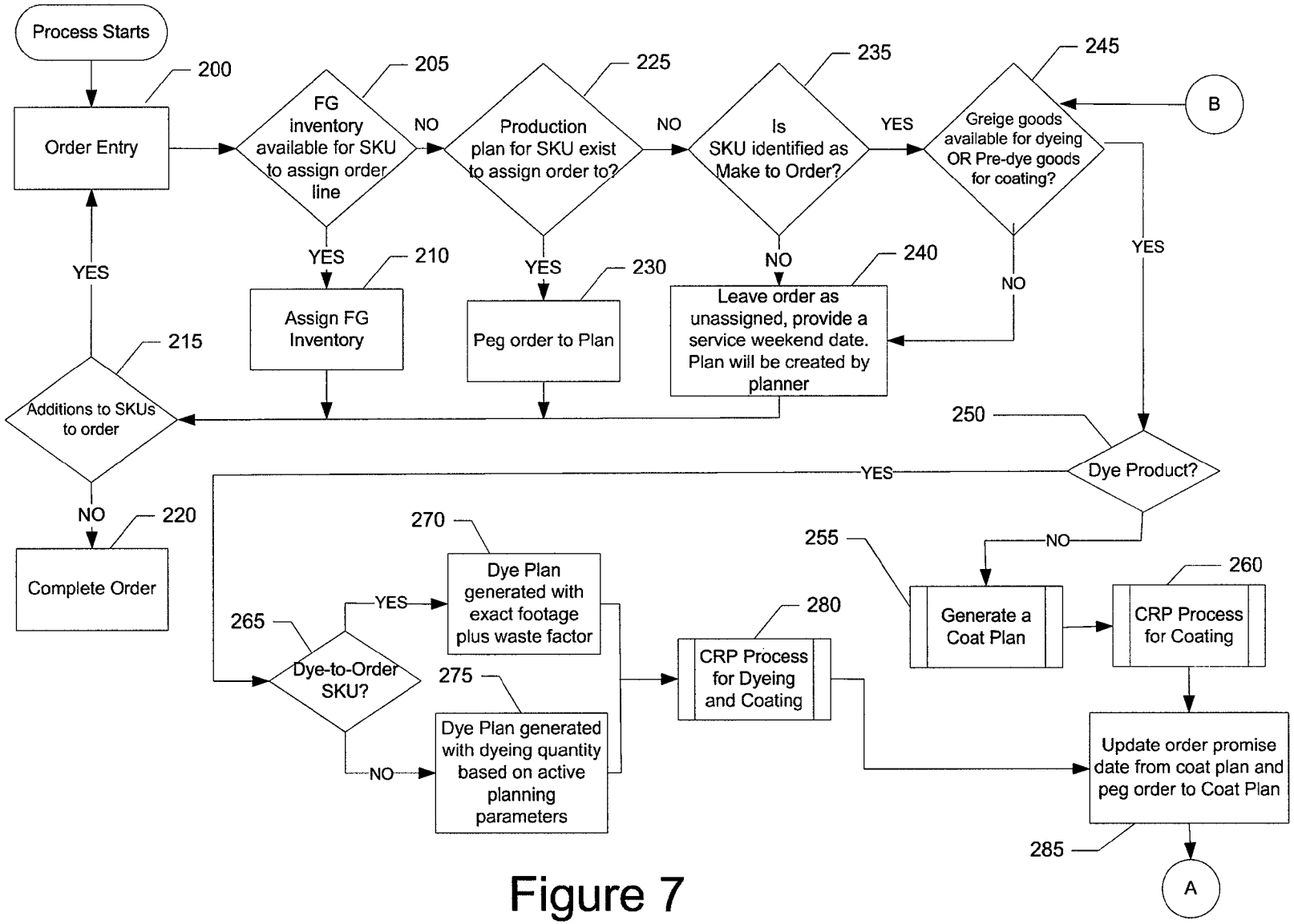
Figure 8:
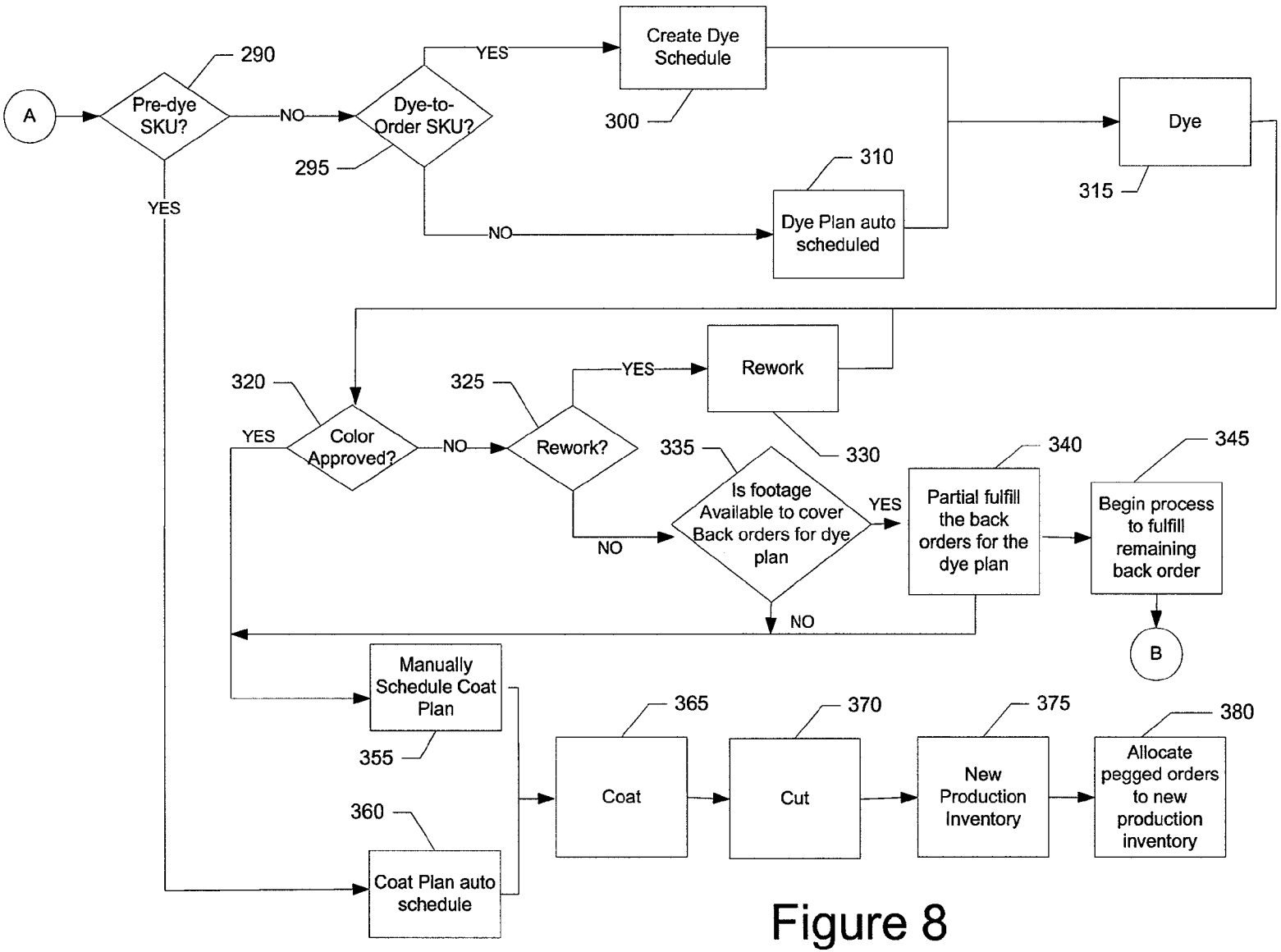

FIGS. 7-8 are flow diagrams illustrating steps for processing orders in accordance to an embodiment of the present invention

DETAILED DESCRIPTION OF THE INVENTION

The present invention now will be described more fully hereinafter with reference to the accompanying drawings, in which some, but not all embodiments of the inventions are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Embodiments of the present invention provide systems and methods for "dye-to-order" carpet manufacturing that address deficiencies in the carpet manufacturing industry, some of which are discussed above. In one embodiment, an improved manufacturing system is provided that allows manufacturers to change colors "on the fly" (e.g., within a single roll) with minimal waste. In another embodiment, a dye-to-order processing system is provided that maps multiple orders to undyed carpet rolls such that usage of the undyed carpet rolls is optimized.

Carpet Manufacturing Process

Embodiments of the present invention may be used with any type or style of carpet. However, to aid understanding of the present invention, the following paragraphs will describe embodiments of the present invention used in the context of a tufted carpet manufacturing process.

The manufacture of tufted carpet typically includes the steps of: (1) tufting yarn (e.g., nylon, olefin, etc.) to a primary backing, (2) dyeing and drying the tufted construction and (3) applying a secondary backing to the primary backing. Tufting generally involves inserting yarn through the primary backing using reciprocating needles. Hooks positioned above the needles grasp the yarn from the needle for a split second after it is forced through the primary backing thereby creating a loop as the needles pass back through the primary backing. These loops may be cut to form cut "pile" carpet. At this stage, the undyed carpet is often referred to as a "greige good." The tufted carpet is then dyed, dried and a secondary backing is affixed to the primary backing.

FIG. 1 is a schematic diagram generally showing a dyeing process in accordance with an embodiment of the present invention. Generally described, the exemplary dyeing system 10 includes a dye mixing system 20 and a dye application system 30. As the names imply, the dye mixing system 20 combines various ingredients to arrive at a desired color and the dye application system 30 receives the mixed dye and delivers it to the carpet 50.

In the illustrated embodiment, the dye mixing system 20 includes two mixing sub-systems 20A and 20B that feed a single dye application system 30, which itself has two holding tanks 32*a-b*. The subsystem system 20A includes storage tanks 21*a-c* that contain ingredients such as colored dyes or other chemicals in various concentrations that may be mixed according to a specific recipe to obtain a desired dye color. Each storage tank has an associated recirculation loop 22*a-c*, in which a pump (not shown) maintains a constant flow rate. Three way valves 23*a-c* are installed in the recirculation loops 22*a-c* such that all or a portion of the flow can be diverted to a mixing tank 25A as desired. Based on a recipe containing the quantity of dye need to obtain a desired color, a three way valve is activated to direct a particular dye to the mixing tank for a predetermined length of time to achieve the necessary quantity of dye. A more detailed description of an exemplary dye mixing system that may be used in connection with the present invention is provided in U.S. Pat. No. 6,050,282 to Whaley, which is incorporated herein by reference. In some embodiments, the valves 23*a-c* may be partially opened to allow a desired flow rate of dye to be diverted to the mixing tank 25A.

Similarly, dye mixing sub-system 20B includes storage tanks 21*d-f*, recirculation loops 22*d-f*, three-way valves 23*d-f* and a mixing tank 25B. These components are arranged substantially the same as described for dye mixing subsystem 20A above. As will be appreciated by those of skill in the art, a single set of storage tanks may have recirculation loops with multiple three-way valves capable of diverting the solution into multiple mixing tanks as opposed to dedicated ingredients as shown in FIG. 1.

In the illustrated example, there are only three storage tanks holding blue, red and yellow dyes. One skilled in the art will appreciated that the subsystems 20A-B may include several storage tanks holding other colors, different concentrations of the same colors or other chemicals that may be mixed to achieve a desired solution. For example, each of the primary colors may have three storage tanks for low, medium and high concentrations, for a total of nine storage tanks.

Once the desired dye solution is prepared in the mixing tank 25A, the solution may be pumped or otherwise fed to the dye application system 30 as controlled by valve 28*a*. As shown, the dye application system 30 includes two holding tanks 32*a-b*, two distribution heads 34*a-b* and a dye head 40. The mixed dye solution from the dye mixing system 20A may be pumped to holding tank 32*a* and the solution from the dye mixing system 20B may be pumped to the holding tank 32*b*. It should be understood that the dye solution from the two mixing tanks may be the same or different colors. Also, a single mixing tank may feed multiple holding tanks within the dye application system 30.

FIG. 6 illustrates another embodiment of a piping system 80 that may be used to direct dye to the dye application system 30 in accordance with various embodiments of the present invention. As illustrated, each of the dyes (red, yellow and blue) includes a recirculation loop 22*a-c* and associated pump 24*a-c*, which maintain a flow rate within the associated loops. The loops also include valves 23*a-c* that may be adjusted to direct all or a portion of the flow of the associated dyes to the mixing tank 82.

In various embodiments, the valves 23*a-c* are proportional-integral-derivative controlled (herein after "PID controlled" or "PID controllers"). Each of the PID controllers receives feedback from flow rate sensors (not shown) positioned downstream of the valves. Generally, dye color recipes may specify the flow rates of particular dyes that are necessary to achieve a desired dye solution. The PID controllers control the degree to which the valves 23*a-c* are opened to achieve the flow rate specified in the recipe. To change from one color to another, the flow rates of the various dyes (red, yellow and blue) may be adjusted such that the quantity of dye being mixed per unit time changes and the resulting new color dye solution is achieved.

As will be discussed in greater detail later, some embodiments require a quick transition between one dye solution to another in order to achieve a desired demarcation strip width between the two dye solution sections of carpet. In some embodiments, the PID controllers may use different algorithms for actuating the valves 23*a-c* when changing from one flow rate to another depending on the difference between necessary flow rates of the particular dyes. For example, if the new flow rate is 15 grams per gallon greater than the current flow rate, the algorithm may open the valve beyond that necessary to achieve the desired flow rate such that the flow rate is ramped up quickly. Because the flow rate will likely overshoot the desired flow rate, the degree to which the valve is opened is then adjusted using feedback from the flow sensors until the flow rate settles at the desired flow rate. In this way, the desired flow rate may be achieved quickly. On the other hand, if the new flow rate is only 1 gram per gallon more or less than the current flow rate, a different algorithm may be implemented where the valve is opened slightly over the degree necessary to achieve the desired flow rate and only minor adjustments are made based on feedback from the flow sensors until the new flow rate is achieved. Since the current and new flow rates are close in this example, it does not take the system long to ramp up (or down) to the desired flow rate, and thus significant changes in valve opening are not necessary.

The valves 23*a-c* direct dyes to the mixing tank 82, which combines the dyes with water or other chemicals to arrive at a desired dye solution. Prior to entering the mixing tank 82, the water passes through a contact water heater 90. A contact water heater raises the temperature of water by placing the water in direct contact with combustion air from a gas burner as opposed to heating a large tank of water. As will be understood by those of skill in the art, carpet dye solutions are often heated to optimize dyeing of the carpet. In some embodiments, the water is heated to 140 degrees Fahrenheit. In other embodiments, contact water heaters are positioned between the dye recirculation loops and the mixing tank 82 such that the dye is heated in addition to or in place of water heater 90 heating the water. Some of the anticipated benefits include improved heat transfer and efficiency of the system. In addition, change over times may be reduced because there is less dye to purge than in prior art systems.

To aid the mixing function, a second mixing tank 84 may be placed downstream of the mixing tank 82. The flow may be assisted by a pump (not shown) between the two mixing tanks.

After exiting the second mixing tank 84, the dye solution may then flow through a damper 86, which is configured to reduce the transfer of pressure spikes through the system. In one embodiment, the damper 86 includes a diaphragm which is supported by air pressure in order to absorb pressure spikes in the system. In some embodiments, the dye head 40 switches quickly from one solution to another, and this can create pressure spikes in the both the piping systems supplying the old and the new dye solutions. The damper 86 mitigates the effect of the pressure shocks on the upstream systems and thus allows quicker changeover from one dye solution to another.

After passing through the damper 86, the dye solution may flow through a third mixing tank 88 to further ensure a substantially homogenous dye solution. Dye exiting the third mixing tank 88 may feed directly to the distribution head 34*a* or to a holding tank 32*a* of the dye application system 30 shown in FIG. 1. As will be discussed in greater detail later, various embodiments of the present invention utilize the new dye solution to purge the old dye solution from the piping system 80. The multiple mixing tanks reduce the length of piping needed to arrive at an acceptably homogeneous dye solution. Because of the reduced piping length, less dye is wasted when purging the system.

The distribution heads 34*a-b* receive the dye solution from the holding tanks 32*a-b*, respectively and are configured to transfer the dye to the dye head 40. Each distribution head 34*a-b* includes multiple feed lines 35*a-b* connected to input ports on the dye head 40 that are spaced uniformly across the dye head width such that the fed dye is distributed across the entire width of the carpet 50. Although illustrated above the carpet for ease of understanding, the dye head 40 can also be positioned under the carpet web, as is known in the industry.

FIG. 2 provides a cross section view of the exemplary dye head 40 showing one of a plurality of feed lines 35*a-b* from each distribution head 34*a-b* entering the dye head 40. As shown, the dye head 40 includes dye input ports 41*a-b* that receive dye from distribution heads 34*a-b*, respectively. The dye head 40 also includes a slot 42 that directs dye to the carpet 50 and an outlet port 43 leading to a valve 46 and a drain 45. A valve 44 controls which input port 41*a-b* is in fluid communication with the slot 42. In the position shown, dye from input 41*a* is directed to the slot 42 and dye from the input port 41*b* is directed to the drain 45. When a color change is desired, the valve 44 is rotated clockwise 90 degrees such that input ports 41*a* and 41*b* are in fluid communication with output port 43 and the slot 42 respectively. When desired, the valve 44 may be rotated counterclockwise 90 degrees to again produce carpet with dye from holding tank 32*a*.

In some embodiments, the valve 44 is replaced with two three-way valves. One of the three-way valves controls whether input port 41*a* is in fluid communication with the slot 42 or with the drain 45. Likewise, the other three-way valve controls whether the input port 41*b* is in fluid communication with the slot 42 or with the drain 45. In various embodiments, an additional valve may be positioned between the two three-way valves and the slot 42 to farther control which of the two three-way valves is in fluid communication with the slot 42.

Dyeing Process

With reference to FIGS. 1, 2, and 6 the following paragraphs describe an exemplary process for making two color changes. The process begins by mixing the necessary ingredients for a first dye color in dye mixing subsystem 20A. This involves adding measured quantities of various dyes and other chemicals according to a recipe into mixing tank 25A. In one embodiment, a plurality of storage tanks 21*a-c* contains various dyes and chemicals in known quantities. Each tank has a dedicated recirculation loop 22*a-c* and a three-way valve 23*a-c* that when actuated, directs the flow from the recirculation loop 22*a-c* to the mixing tank 25A. According to a recipe, three-way valves for select recirculation loops are opened for predetermined times to add the necessary dye or chemical to the mixing tank 25A. In other embodiments, the valves 23*a-c* located in the various recirculation loops are adjusted to allow a desired flow rate to the mixing tanks according to a recipe.

After the dye is mixed, it is pumped into holding tank 32*a* in the dye application system 30. This dye is then fed from the holding tank 32*a* through the distribution head 34*a* and dye head 40 onto the carpet 50. In other embodiments, the dye flows directly from the final mixing tank (e.g., mixing tank 88) into the distribution head 34*a*.

Meanwhile, a second color is mixed in the dye mixing subsystem 20B as generally described above with reference to the mixing subsystem 20A. This second color is fed into holding tank 32*b*. Once the desired length of the first color carpet is dyed, the valve 44 in the dye head 40 is rotated such that the second color is fed through the slot 42 onto the carpet. Any of the first color dye remaining in the slot may be flushed out by the second dye color. The slot may also be flushed with water.

Next, a third dye solution is mixed in dye mixing subsystem 20A as generally described above with reference to the first dye color. It should be understood that the third dye color mixing process may be initiated shortly after emptying the first color from the mixing tank 25A into the holding tank 32*a*. Once the third dye color is mixed, it may be fed into the holding tank 32*a* and a portion of the third dye color may be allowed to flow into the distribution head 34*a* and dye head 40 thereby flushing out residue of the previous dye color (i.e. the first dye color) and priming the third dye color. The flushing process of the residue from the first dye color can take place while the second dye color continues to be applied to the carpet 50. Due to the position of the valve 44, the residue is flushed to the drain 45. In one embodiment, the flushing process is allowed to continue for a predetermined period of time or quantity of fluid. In an alternative embodiment, the flushing process continues until the new dye color (i.e. the third dye solution in this example) is detected at the drain. At this point, valve 46 leading to the drain is closed to stop the flushing process and the valve 44 may be rotated to apply the third dye color when desired. Because the second dye color can be continuously applied during the flushing of the first dye color and the priming of the third dye color, the transition from the second dye color to the third color can be substantially instantaneous.

FIG. 3 is a schematic diagram of an exemplary length of carpet dyed in accordance with an embodiment of the present invention. As shown, the length of carpet includes two dyed sections 51 and 52 with an undyed demarcation strip 53 therebetween. Carpet section 51 is dyed to Color A and section 52 is dyed to Color B with the undyed demarcation strip 53 having a width "d". The minimum "d" value for a given process is a function of how quickly the dyeing process can be switch from Color A to Color B. Using the dyeing system 10 described above, the width "d" can be held to 1.5 inches or less at a standard processing speed of 60 feet per minute. The width "d" may be increased as desired by delaying the application of the next color. This may be accomplished by slowing the action of the valve 44 or installing an additional valve between the distribution head and the carpet. For example, some embodiments may have demarcation strips held to less than 18 inches, 12 inches or six inches.

In some embodiments, the demarcation strip 53 may be used to identify the transition from one color to the next when the colors themselves are difficult to distinguish. In other embodiments, the carpet sections may be sequenced or the section lengths adjusted to position the demarcation strip at a seam between carpet rolls. Seams and undyed strips are typically cut from the finished carpet and discarded. In one embodiment, the demarcation strip helps identifying the seam and/or a change in dye color for an operator or automated cutting system, which may use a sensor to detect the undyed demarcation strip.

The dyeing system 10 described above is capable of substantially eliminating the undyed strip so that one dye section ends and a new section begins at the same linear position. Thus, a roll of carpet may be manufactured having various different dye section colors. Furthermore, this process may be used to create a carpet having a striped pattern. For example, carpet may be produced with a repeating pattern consisting of a predetermined length of Color A (e.g., a two foot section) followed by a predetermined section of Color B (e.g., a three foot section). This quick changeover helps economically justify smaller production runs of any given color, because the wastage between productions runs can be greatly reduced.

Dye-to-Order Processing System

In a further aspect of the invention, an order processing system is provided for optimizing the use of greige goods to fulfill known and/or expected orders. FIG. 4 is a schematic diagram of one embodiment of the order processing system 60. The system 60 includes a mainframe computer 61, and a data repository 72.

The mainframe computer 61, which may be an iSeries AS/400, includes an order entry module 62, a dye-to-order ("DTO") module 63 and a transfer module 64. The order entry module 62 initially receives data from a customer such as their identity (e.g., name, and address), a requested delivery date and a SKU. The order entry module may use the received information to retrieve other data related to the order such as a style code, a color code, a size code, a backing code, other customer information. The order entry module may also assign an order number and calculate a customer promise date. In one embodiment, the order entry module queries the data repository 72 using the SKU number to retrieve the additional data. If there is no inventory available or an existing production plan for the SKU, this information is transferred to the DTO module 63 for processing.

The DTO module 63 determines whether the order can be produced using existing greige rolls or whether new greige rolls will need to be produced. The DTO module then assigns existing orders to greige rolls to optimize yield of the greige rolls and enters the information into a dye production schedule.

The transfer module 64 tracks the location of greige rolls and directs the transfer of greige rolls to warehouse locations or manufacturing facilities to satisfy the dye production schedule created by the DTO module 63. This module may update physical inventory data in the data repository 72 as necessary.

The data repository 72 includes one or more databases for storing information associated with the production process and the products manufactured. Information stored in the data repository related to the production process may include equipment limitations such as feed rates, width limitations and the number of color changes allowed per standard carpet length.

Data associated with the products manufactured may include SKU profiles which may contain details about a given product such as a style code, a color code, a color recipe, a dye code and/or raw material details such as types of yarns, backings, and coatings. The data repository 72 may also include sales ranking data for each SKU. In one embodiment, a manufacturer assigns each SKU to one of several categories (e.g., a sales ranking) based on its historical sales volume. Over time, a particular SKU's sales ranking (or category) may change due to a change in sales volume for that particular SKU.

The data repository 72 may also include physical inventory data identifying quantities and locations of various raw materials and work-in-process such as the quantity and location of greige goods. Inventory data associated with finished goods may also be stored in the data repository 72.

Users may access the mainframe computer 61 via "dummy" terminals 76 or via a computer 77 over a network 78. Those skilled in the art of data networking will realize that many other alternatives and architectures are possible and can be used to practice the principles of the present invention. For example, the order processing system may be run on one or more networked computers or on a distributed architecture utilizing servers communicating with multiple computers over a network.

FIG. 5 is a process flow diagram illustrating steps for a DTO processing in accordance with an embodiment of the present invention. The process begins at Step 100 with the receipt of an order. The order may include an SKU number, the length of the carpet ordered and a promised delivery date. This promised date is generally determined based on the production plan and transportation lead-times.

At Step 105, the order details are analyzed to determine if it qualifies for the DTO process. In one embodiment, the DTO process is triggered when one or more parameters of the order satisfy predetermined thresholds such as a minimum or maximum order length. Provisions may also be provided for manually flagging orders for the DTO process. For example, an order may be flagged for DTO processing if it is a special one time order of a particular style or color. Alternatively, dye-to-order processing may be triggered if the received order cannot be filled from current inventory or a plan does not already exist for producing the ordered carpet.

An additional parameter for triggering DTO processing may be the popularity of the SKU ordered. The relative popularity of an SKU may be designated by the SKU's sales ranking, which is based on historical sales data. For example, each SKU offered by a manufacturer may be assigned one of the following rankings: A, B, C, E, F and G. Rankings A, B and C may be relatively high volume SKUs and rankings E, F and G may be relatively low volume SKUs. In one embodiment, the low volume SKU rankings (e.g., E, F and G) trigger DTO processing. Alternatively, specific rankings may trigger DTO processing such as an F and G ranking. It should be understood that any type of sales ranking scheme may be used in connection with the present invention and that any combination of high and/or low volume SKU rankings may trigger DTO processing as desired.

It should be understood that any combination of parameters discussed above for triggering DTO processing may be used in connection with the present invention. In an alternative embodiment, the system may include a switch allowing a user to specify that all or none of the orders are to utilize the DTO process.

Assuming DTO is triggered at Step 105, the process continues to Step 110 where a DTO plan is created. The DTO plan assigns the ordered SKUs to standard greige rolls (e.g., undyed carpet rolls). Various factors may be considered when creating the DTO plan, which is the optimum assignment of ordered SKUs to greige rolls. Generally, the orders of a particular style of carpet and therefore a particular style of greige good are grouped together and then assigned to standard greige rolls (e.g., 150 foot length of undyed carpet).

One factor in assigning SKUs to particular rolls may be the ordered length for the particular SKUs as compared with a standard greige roll. A waste factor may be added to each order before starting the optimization process. In one embodiment, a heuristic process is used to determine how to combine the orders to optimize utilization of greige rolls. In other words, various combinations of orders are mapped to a standard greige roll in order to identify the combination having the best utilization of the roll. As will be appreciated by those skilled in the art, other optimization algorithms may be used to assign SKUs to greige rolls.

As part of the optimization process, standard lengths of high volume colors may be added to finish partial rolls. For example, a 30 foot section of an "A" sales ranked SKU may be included in the combination of DTO orders when optimizing the allocation of a greige roll. The selection of the "A" SKU may be based on a variety of factors such as the relative inventory levels of the different "A" ranked SKUs. The "A" SKU may be placed at the end of the roll such that any length variation in the roll will be absorbed by a popular style of carpet. It is not uncommon for carpet rolls to stretch during processing such that the finished roll is 10 to 15 feet longer than it was during the initial processing. By placing the "A" SKU at the end of the roll, any additional length would be in a popular color, which would have a better chance of being sold than extra lengths of an unpopular color.

An additional factor that may be considered in assigning SKUs to greige rolls is the sequence of colors dyed for a given greige roll. When dyeing a section of carpet in a new color, the beginning portion of the dye section of the carpet is the portion where shade variations are most likely to occur. These shade variations may be due to residual dye from the previous dye section flowing through the dye head, which may cause a slight blending of the old and new dye colors. However, if a previous dye color and a new dye color are similar and related, it is less likely that the beginning portion of the new dye section of carpet will be out of shade (e.g., color) tolerance. For example, there will be decreased scrap losses if a red dye section of carpet is followed by a pink dye section as compared to a sequence where a red dye section is followed by a white dye section. Although the same dye blending may occur, the effect is less obvious to a consumer and more likely to be within acceptable tolerance levels for the red-pink example.

In one embodiment, the processing system sequences colors to minimize the visual effect of any blending of sequential dyes in the dyeing system. This may be accomplished using a master sequence of all SKUs that is consulted by the processing system. Alternatively, the SKUs may be sequenced based on concentrations of the dyes (e.g., blue, red and yellow) where SKUs having similar concentrations are placed in sequence.

In a further embodiment, the processing system may avoid placing incompatible colors in sequence. This may be performed by comparing the concentrations of the various dyes used to arrive at specific colors and not allowing SKUs to be in sequence if the concentrations of the dyes (e.g., blue, red and yellow) differ between the two colors by more than a predetermined threshold. Different thresholds may exist for different styles of carpet. The dyeing sequence may also be determined by the relative dye concentrations. For example, it may be preferred to dye a relatively light color before a darker color due to residue from the previous dye. It has also been discovered that the compatibility of various dye colors may be one-way in nature. For example, it may be acceptable to go from a red to an orange but not from orange to red. In various embodiments, the system considers whether the specific sequence of dye changes is acceptable.

Limitations may also be imposed on the number of color changes for a given greige roll. For example, some equipment may only be able to accommodate a limited number of color changes for a standard roll. Accordingly, embodiments of the present invention may consider limitations of the proposed processing equipment when assigning SKUs to a greige roll. In an alternative embodiment, the processing equipment may be assigned based on the number of color changes needed to optimize the greige roll.

In one embodiment, a DTO plan is created at Step 110 when orders are received. In some embodiments, the DTO plan is re-optimized at predetermined times to determine if better combinations of colors exists or better utilization of greige rolls can be achieved. In one embodiment, this re-optimization occurs just prior to converting all or a portion of the DTO plan into a dye production schedule at Step 120.

After determining a DTO plan at Step 110, the physical greige rolls to be dyed according to the DTO plan are located or produced at Step 115. In one embodiment the DTO system queries inventory records and reserves the physical greige rolls for the associated SKUs in the DTO plan. The physical greige roll may be located in a separate facility. If a physical roll cannot be found in inventory, one may be scheduled to be produced. Also, as new orders arrive and re-optimizing of the orders occurs, physical rolls may be added back to inventory if they are not longer needed due to the optimization process.

At Step 120, all or a portion of the DTO plan is entered into the dye production schedule. The dye production schedule provides a detailed plan specifying equipment and production times for dyeing individual greige rolls. If necessary, the dye production schedule takes into account the time necessary to produce or deliver greige rolls as necessary.

A DTO plan may be kept open (i.e., not entered into the dye production schedule) for a predetermined time frame or until certain parameters are met. For example, a DTO plan may be entered into the dye production schedule based on the customer promise date. Using predetermined manufacturing and transportation lead-times, a deadline date may be established for initiating the dyeing process in order to satisfy the customer promise date. The portion of a DTO plan associated with a particular SKU may be kept open until that SKU reaches this deadline date. In this embodiment, the order would be placed in the dye production schedule on or before the deadline date. Other SKUs assigned to the same greige roll would also be added to the production dye schedule at that time. The system may also allow a user to alter the dye production schedule as desired.

A relatively common occurrence in the carpet manufacturing industry is the cancellation or alteration of an order. For example, a customer may cancel an order, or change its parameters such as the length, style or color ordered. In an embodiment of the present invention, a user may access the DTO processing system and remove or alter pending orders. The system may then re-shuffle or re-optimize the current orders as generally described above.

After dyeing, the carpet is further processed. In various embodiments, a resulting roll of carpet may include multiple different SKUs. In the prior art, each carpet roll was typically a single SKU and therefore individual orders could be cut from the finished rolls in any sequence. However, with the introduction of multiple SKUs on a single roll, the cutting sequence takes on greater importance because an improper cutting sequence could lead to the wrong SKU for a particular order or multiple SKUs on a cut order. Various embodiments of the processing systems 60 track the orders assigned to particular rolls and the dyeing sequence such that the orders can be cut from the finished carpet roll in the proper sequence.

In various embodiments, the processing system tracks the dyed sections of carpet and notes the dye lot from which each section was dyed. Because color variations may occur between dye lots of the same prescribed color, the system may avoid sending carpet sections having nominally the same color but having different dye lots to the same customer. However, if one dye lot is used at the tail end of one roll and at the beginning of a subsequent roll, the system may allow the two dye sections to be shipped to the same job site since they were produced using the same dye lot. However, if there is an intervening dye lot between two dye lots of nominally the same color, the system may avoid sending those two sections to the same job site.

During the dyeing or subsequent processing, an error may occur that results in the finished carpet not satisfying an associated order. For example, the color may not meet quality standards or the length of carpet produced does not satisfy the quantity ordered due to a cutting error. In one embodiment, the DTO system allows a user to enter a replacement order and initiate the optimization routine (DTO processing) to schedule the dyeing of a greige roll as soon as possible to satisfy the customer's order.

FIGS. 7-8 describe another method for processing orders in accordance with an embodiment of the present invention. More particularly, FIG. 7 illustrates a process for establishing a promised completion date for a customer's order. FIG. 8 illustrates a process generating an actual production schedule for the various orders received.

Turning to FIG. 7, the process begins at Step 200 with the entry of an order into the system. The order may include a SKU and a length. A check is then made at Step 205 to determine if the order can be satisfied with product currently in inventory. If inventory is available, the associated inventory allocated to the order at Step 210.

In some instances, a customer order may include multiple SKUs. At Step 215, a check is made to determine if additional SKUs exist for the particular order. If so, the process returns to Step 200 where an additional SKU may be entered into the system. If no additional SKUs exist, the order is complete and the process ends at Step 220.

Assuming that no inventory exists for the entered SKU at Step 205, the process continues to Step 225 where the system searches its database for an existing production plan for the ordered SKU. If one exists, the order is "pegged" to the specific order at Step 230. In other words, a portion of the production plan is allocated to the specific order. This may occur when the order is for a popular SKU that is run on a periodic basis independent of specific orders. Once the order is pegged to the production plan, the process continues to Step 215 where additional SKUs for the customer order may be entered.

If no production plan exists that can satisfy the specific order, a determination is made at Step 235 as to whether the order qualifies as a "Make to Order" product. This determination may be made based on the popularity of the particular SKU. For example, a highly popular SKU may not qualify because these types of SKUs are manufactured often and the risk of this type of SKU being stored in inventory for an extended period of time is relatively low. An unpopular SKU (e.g., low popularity ranking) may qualify for "Make to Order" processing because these types of SKUs are rarely manufactured, and the cost of storing these types of SKUs in inventory can be expensive. Assuming the SKU does not qualify for "Make to Order" processing, the order is temporarily left unassigned until a standard production plan can be created for the SKU at Step 240. The process then continues to Step 215.

If the SKU qualifies for "Make to Order" processing at Step 235, the process continues to Step 245 where a check of inventory of greige goods or pre-dye goods is made. If no greige goods or pre-dye goods for the particular SKU exist in inventory, the process continues to step 240 where the order is left unassigned. A production plan will need to be created for the necessary greige or pre-dye goods.

If the greige goods or pre-dye goods exist, a determination is made at Step 250 as to whether existing goods need to be dyed. Greige goods are work-in-process rolls of carpet than have not yet been dyed and coated. On the other hand, "pre-dye" goods are rolls of carpet which have been dyed but have not yet been coated. As will be understood by those skilled in the art, various types of coatings may be applied to carpet such as various stain resistant coatings. If at Step 245 it is determined that dyeing is not necessary, a coat plan is created at Step 255 and constraint resource planning (i.e. "CRP") is performed at Step 260. The constraint resource planning step involves identifying the appropriate equipment to produce the SKU based on a number of factors such as the capabilities of the equipment (e.g., width constraints, styles of carpet that may be run) and verifying the selected equipment's availability.

If the existing goods require dyeing (i.e. are greige goods), the process continues to Step 265 where a determination is made as to whether the SKU qualifies for Dye-to-Order processing. This determination may be made based on the popularity ranking of the SKU coupled with the length ordered. If the SKU qualifies for Dye-to-Order processing, a dye plan is created for the exact footage ordered plus a waste factor at Step 270. The waste factor may be a percentage of the total length or a predetermined additional length. Otherwise, at Step 275 a standard dye plan is created, which may be based on dyeing a standard length (such as a number of rolls) of greige goods instead of the actual footage ordered.

Continuing to Step 280, constraint resource planning is performed to select the necessary equipment to dye and coat the existing greige goods. At Step 285, a promise date is estimated as to when the coating process will be complete.

Turning to FIG. 8, the process for scheduling specific orders begins at Step 290 where a determination is made as to whether the work-in-process goods slated to create the finished product are pre-dyed. If not, the process continues to Step 295 where a determination is made as to whether the product is a Dye-to-Order SKU. Assuming the SKU qualifies for Dye-to-Order processing, a dyeing schedule is created at Step 300. The greige goods are then dyed at Step 315 according to the created schedule. If the SKU does not qualify for Dye-to-Order processing, the SKU is entered into a general dye plan and is eventually dyed at Step 315.

After dyeing, quality checks are performed at Step 320. If the color of the dyed product is not approved, the product is evaluated to determine if it can be reworked at Step 325. If the product is reworkable, the rework operation occurs at Step 330 and the reworked product is evaluated again at Step 320. Otherwise, a determination is made as to whether the dyed product can be used to fill backorders at Step 335. If not, the product continues to Step 355 where a coating schedule is generated. If the dyed product can at least partially fulfill a back order, the process continues to Step 340 where the dyed product is associated with the back order. The process continues to Step 345 where a request to fulfill the remaining portion of the back order is made and then the process returns back to Step 245 to initiate a new order to satisfy the remaining backorder. Meanwhile, the actual product continues to Step 355 where a coating schedule is generated. The dyed goods are then coated at Step 365 according to the schedule, cut (Step 370), and the finished product placed into inventory (Step 375). Pegged orders are also placed into new production inventory at Step 380. From here, the finished product is available for shipping to the customer to fulfill the order.

Assuming the work-in-progress was determined to be pre-dyed at Step 290, the process continues to Step 360 where a coating schedule is generated. The goods are then coated at Step 365 according to the schedule, cut (Step 370), and the finished product placed into inventory (Step 375). Pegged orders are also placed into new production inventory at Step 380. From here, the finished product is available for shipping to the customer to fulfill the order.

It should be understood that other many modifications and other embodiments of the invention set forth herein will come to mind to one skilled in the art to which the invention pertains having the benefit of the teachings presented in the foregoing descriptions, and the associated drawings. For example, the DTO system may be implemented for non-tufted carpet. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of dyeing carpet to satisfy a plurality of customer orders comprising the steps of:

receiving a plurality of customer orders wherein each order identifies a color and a length;

identifying which colors cannot be dyed in sequence based on a visual effect of blending of sequential dyes at a transition between colors in sequence;

determining a dyeing sequence for at least a portion of the plurality of customer orders, based on the colors identified by the respective orders and the identification of colors that cannot be dyed in sequence, to reduce the visual effect of blending of sequential dyes at a transition between colors in the sequence;

assigning the plurality of customer orders to one or more greige rolls of carpet based at least in part on the determined dyeing sequence wherein at least one greige roll of carpet has at least one transition from one color to another color; and dyeing the one or more greige rolls of carpet;

wherein the step of dyeing the one or more greige rolls of carpet comprises:

feeding said one or more greige rolls through a dye application head which switches from one color to another color according to a respective customer order.

2. The method of dyeing carpet of claim 1, wherein the step of assigning the plurality of customer orders comprises the step of:

mapping the customer orders to one or more greige rolls having predetermined minimum lengths to reduce unallocated portions of the greige rolls.

3. The method of dyeing carpet of claim 2, wherein the maximum number of color transitions for individual greige rolls is set by a predetermined threshold.

4. The method of dyeing carpet of claim 2 further comprising the step of assigning at least a portion of the greige roll not allocated to the plurality of customer orders a predetermined standard color.

5. The method of dyeing carpet of claim 1, wherein the step of determining which of the plurality of customer orders can be dyed in sequence comprises the step of allowing customer orders to be dyed in sequence if the concentrations of dyes necessary to achieve the colors identified are within a predetermined threshold of each other.

6. The method of dyeing carpet of claim 1, wherein lighter colors are sequenced prior to darker colors.

7. The method of dyeing carpet of claim 1, wherein the plurality of customer orders includes a first order identifying a first color, a second order identifying a second color and a third order identifying a third color, and wherein the step of dyeing the one or more greige rolls of carpet comprises:

mixing a first dye solution for the first color in a first mixing system;

mixing a second dye solution for the second color in a second mixing system;

feeding a greige roll of carpet through a dye application system;

actuating at least one multi-port valve in the dye application system such that the first dye solution is applied to a first portion of the greige roll of carpet as it passes through the dye application system;

actuating the at least one multi-port valve in the dye application system such that the second dye solution is applied to a second portion of the greige roll of carpet as it passes through the dye application system;

mixing a third dye solution for the third color in the first mixing system while the second dye solution is being applied;

purging residue of the first dye solution from the mixing system and at least a portion of the dye application system using the third dye solution; and actuating the at least one multi-port valve in the dye application system such that the third dye solution is applied to a third portion of the greige roll of carpet as it passes through the dye application system.

* * * * *

UNITED STATES PATENT AND TRADEMARK OFFICE

CERTIFICATE OF CORRECTION

PATENT NO. : 8,082,057 B2
APPLICATION NO. : 12/108875
DATED : December 20, 2011
INVENTOR(S) : Allen et al.

It is certified that error appears in the above-identified patent and that said Letters Patent is hereby corrected as shown below:

Column 7

Line 31, "farther" should read --further--

Signed and Sealed this
Twenty-eighth Day of February, 2012

David J. Kappos

David J. Kappos
*Director of the United States Patent and Trademark Office*